US006474540B1

(12) United States Patent
Barr et al.

(10) Patent No.: US 6,474,540 B1
(45) Date of Patent: Nov. 5, 2002

(54) INTEGRAL INSERT PACKAGING

(75) Inventors: Lance Barr, Carnation, WA (US); Masahito Watanabe, Maple Valley, WA (US)

(73) Assignee: Nintendo of America Inc., Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/543,553

(22) Filed: Apr. 5, 2000

Related U.S. Application Data

(63) Continuation of application No. 09/328,386, filed on Jun. 9, 1999

(60) Provisional application No. 60/128,812, filed on Apr. 12, 1999.

(51) Int. Cl.[7] ..... B65D 25/04

(52) U.S. Cl. ..... 229/120.21; 229/153; 206/461

(58) Field of Search ..... 206/232, 387.11, 206/384.14, 461, 465, 806; 229/153, 120.21

(56) References Cited

U.S. PATENT DOCUMENTS

| | | | | |
|---|---|---|---|---|
| 3,237,836 | A | * | 3/1966 | Nowak et al. |
| 3,985,232 | A | * | 10/1976 | Johnson |
| 4,134,495 | A | * | 1/1979 | Friedman |
| 4,365,714 | A | * | 12/1982 | Doyal |
| 4,470,502 | A | * | 9/1984 | Swanberg |
| 5,263,586 | A | * | 11/1993 | Keable |
| 5,289,917 | A | * | 3/1994 | Chabria |
| 5,871,145 | A | * | 2/1999 | Hermann et al. |
| 6,112,978 | A | * | 9/2000 | Barr et al. ..... 229/120.21 |

* cited by examiner

*Primary Examiner*—David T. Fidei
(74) *Attorney, Agent, or Firm*—Nxion & Vanderhye PC

(57) ABSTRACT

A product package formed from a one piece box blank that is pre-scored to define the panels of the box and an insert portion for defining a product compartment within a larger box interior. The insert portion includes a front panel, a side panel and an end closure structure for closing the end(s) of the insert compartment Adhesive is applied to select panels so that when the blank is folded and then squared, the box is ready to receive the product, e.g., a literature insert.

21 Claims, 6 Drawing Sheets

INTEGRAL INSERT PACKAGING

This application is a continuation of Ser. No. 09/328,386 filed Jun. 9, 1999, which claims the benefit of U.S. Provisional Application Ser. No. 60/128,812, which was filed Apr. 12, 1999, the disclosure of which is incorporated herein by this reference.

BACKGROUND OF THE INVENTION

1. Field of the Invention

The present invention relates to product packaging and, in particular, to a foldable one-piece box blank for forming a product package having an integral insert, and an integral insert package formed therefrom.

2. Description of Related Art

A variety box blanks are known and available for packaging products of various types and sizes. Some products, however, present challenges to the package designer. For example, some products are packaged with product literature which the manufacture may desire be held in a separate compartment or region of the package from the product, thus requiring interior compartments be provided for the product and/or the instructional or informational literature. Other products are particularly small, indeed smaller than accompanying literature and/or smaller than a size desirable for display and sale. Such products must therefore be held in a portion of a larger package, to avoid damage to the product and so that the product is of a reasonable, marketable size. An example of such a product is a game pack or cartridge for a video entertainment system.

Thus, two-part packaging has been developed that includes a package insert for compartmentalizing the product box to accommodate small products and package inserts. An example of an insert for such a prior art two-part package is illustrated in FIG. 1. The insert 10 is designed to define a product-receiving recess for receiving, for example, a game pack for a video entertainment system, the insert 10 being adapted to be received in a conventional, larger product box (not shown). To form the insert 10, one panel 12 is folded on score line 14 to overlie the other panel 16. Adhesive 18 is provided at spaced locations to adhere the panels 12, 16 in this disposition. Then, side flap 20 is folded on score line 22 so that adhesive 24 provided thereon and/or on the opposing surface of side flap 26 adheres the side flaps 20, 26 to each other. When the insert is then squared to define a three-dimensional insert, a recess/compartment is defined by panels 28, 30, 32 and 34, into which the game pack, for example, or other small product may be disposed. An insert such as insert 10 typically has a height less than the depth of the larger, product display box interior, to define a space for product related literature.

Another prior art insert is illustrated in FIG. 2. In this example, to form the insert from blank 38, panel 40 is first folded on score line 42 so that adhesive provided at 44 adheres to the opposed surface of the blank 38. Then panel 46 is folded on score line 48 so that 25 adhesive, for example, provided at 50 adheres on contact to the facing blank portions. When the insert is then squared up, a recess/compartment for a product, such as a game pack, is defined by panels 52, 54, 56 and 58. Again, the insert will typically have a height less than the depth of the product display box, so as to permit product literature to be received in the box as well.

SUMMARY OF THE INVENTION

It is an object of the present invention to provide a product package that defines a compartmentalized interior. A further object of the invention to provide a compartmentalized interior for a product package in a manner well suited for efficient machine or hand assembly, to lower assembly costs.

It is a further object of the invention to provide a compartmentalized package formed from a single box blank so as to realize inventory efficiencies.

It is also an object of the invention to provide a one-piece box configuration, which is strong and durable for its intended purpose.

The foregoing and other objects of the invention are realized by providing a product package formed from a one piece box blank that includes an insert blank portion for defining a product compartment within a larger box interior.

The concept of the invention can be applied to any product packaging wherein the formation of a compartment within the box interior is deemed necessary or desirable. For purposes of specific example, the invention is advantageously applicable to a game pack for a hand held or home video game machine.

The foregoing, as well as other objects and advantages of this invention, will be more completely understood and appreciated by careful study of the following more detailed description of a presently preferred exemplary embodiments of the invention taken in conjunction with the accompanying drawings.

DETAILED DESCRIPTION OF THE DRAWINGS

DETAILED DESCRIPTION OF THE PRESENTLY PREFERRED EXEMPLARY EMBODIMENTS

Figure 1:
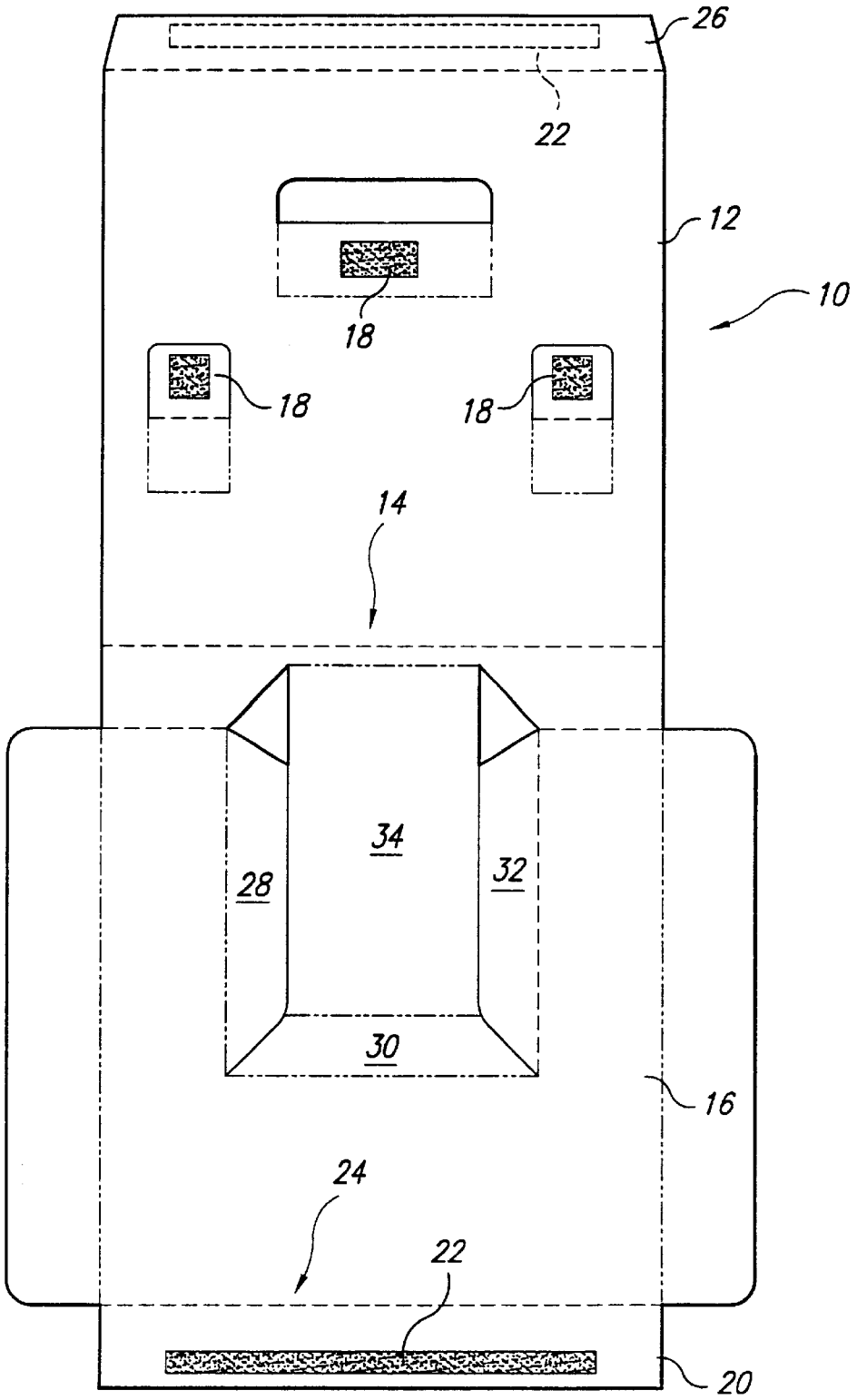
Fig. 1 PRIOR ART
FIG. 1 is a plan view of a prior art box insert blank.
Figure 2:
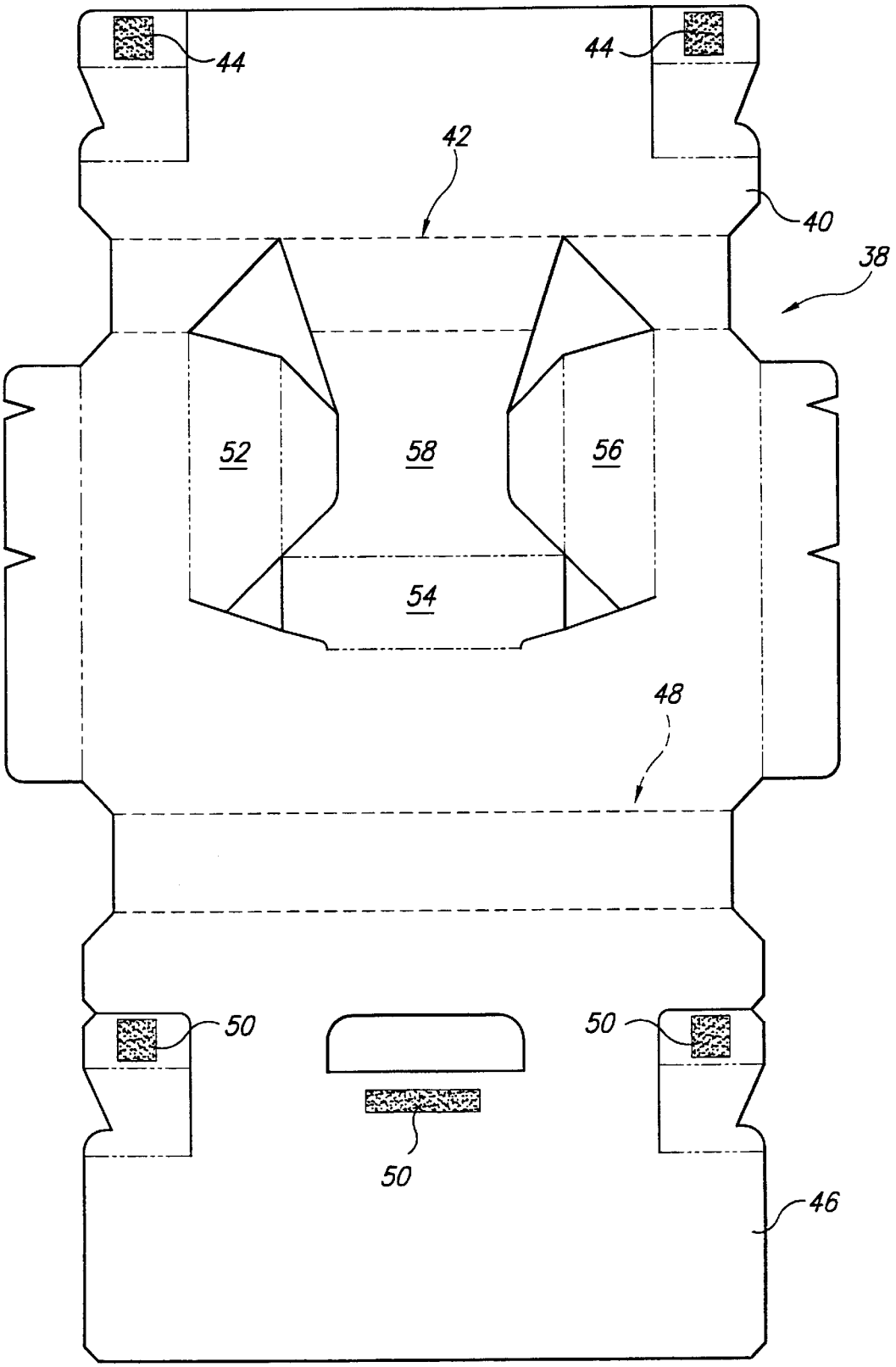
Fig. 2 PRIOR ART
FIG. 2 is a plan view of another prior art box insert blank.

Foldable boxes or cartons for receiving multi-component products, small size products and/or products with product literature, as explained above with reference to prior art FIGS. 1 and 2, typically comprise two box blanks; one blank for forming the box for product display and the other blank for forming a compartmentalizing insert. As is apparent from those FIGURES, such foldable boxes are typically formed as a flat blank which is provided with a number of score lines which allow the side walls, end walls, etc. of the box to be formed.

It is to be understood that, as used herein, score line encompasses any line provided on a paperboard or cardboard blank for allowing the same to be folded. Thus, score line encompasses a preformed fold line which is free from perforations, partly perforated, or fully perforated. Providing perforations along the fold line facilitates folding certain portions of the blank. Thus, in the illustrations of the prior art and the illustrations of the invention, a continuous line is used to show a cut in the material of the blank, a dash line has been used for showing a fold line which may be but is not necessarily perforated, and a dash dot line has been used to show a line that in the case of the prior art is known to be, or in the case of the invention is preferably, formed as a perforated line. Thus, as used herein score line generically refers to a line of weakness whether a non-perforated line or a perforated line. Moreover, it is to be understood that any references, by word or illustration, to the type of line of weakness are for the purposes of describing the presently preferred embodiment(s), but are not intended to limit the invention.

For ease of disclosure and to provide a frame of reference, portions of the blank provided in accordance with the present invention and the box formed therefrom are referred to using terms such as front, back, side, end, and the like. It is to be understood that these descriptors are for purposes of convenience only and are not intended to limit the configuration of the product package or the orientation of the product insert(s) with respect to the remainder of the box.

For convenience and to provide a frame of reference, the packaging provided in accordance with the invention will be characterized as including a main box and an insert. As used herein, the main box is that portion of the box that would be seen, e.g, by the consumer when the box has been formed and closed. The insert is disposed in the interior of the main box and, thus, can generally only be seen when the formed, main box is open at one or both ends.

In the orientation illustrated in FIG. 3, the surface of the blank facing the viewer is the side of the blank adapted to receive print, e.g., for defining the outer surface of the packaging and thus the surface of the blank facing the viewer will be referred to herein below as the printed side, whereas the other surface of the blank will be referred to herein below as the unprinted side.

Finally, for purposes of convenience and reference, terms such as fold and folding are used herein to refer to folding along score lines, e.g., so that a portion or portions of the blank overlie another portion or portions of the blank, but do not necessarily refer to the formation of a three dimensional box. Instead, for convenience, the formation of a three dimensional box is referred to as squaring.

Figure 3:
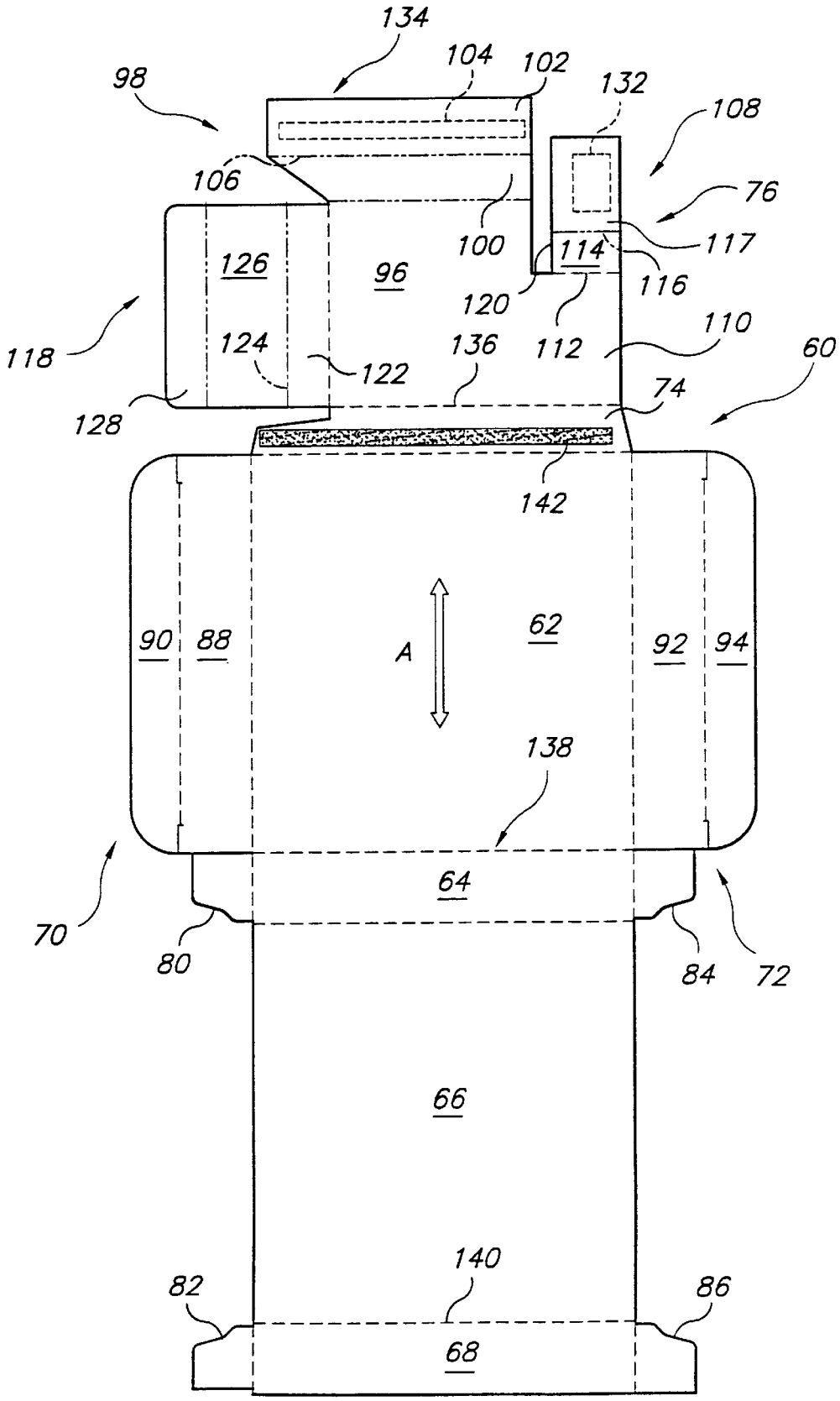
FIG. 3 is a plan view of a box blank formed in accordance with one embodiment of the present invention.

Referring now to the illustrated embodiments of the invention., a blank 60 for forming a product package with integral insert in accordance with one embodiment of the invention, is shown in FIG. 3. As can be seen, the blank is pre-scored to define a back panel 62, a first side panel 64, a front panel 66, a second side panel 68, first and second closure panels 70, 72, and a third side panel 74. The foregoing panels in the illustrated embodiment define, on folding and squaring, the main box 78 of the product packaging. The illustrated blank further includes an insert portion 76 for integrally forming a product compartment in the interior of the main box 78.

In the illustrated embodiment, closure panel 70 includes an end panel 88 and an end tab 90, and closure panel 72 includes an end panel 92 and an end tab 94. Tabs 90 and 94 are for being inserted under the front panel 66 in a conventional manner when the box is formed, squared, filled, and closed. Moreover, the illustrated box blank 60 has a first set of ears 80, 82 for the bottom end of the box and a second set of ears 84, 86 for the top end of the box, the ears being respectively received under end panels 88 and 92, also in a conventional manner.

Although in the illustrated embodiment end tabs 90 and 94 are provided, it should be understood that as an alternative to providing such tabs, on either or both ends of the box blank, end panels or flaps may be provided on each of the front and rear panels of the blank, adapted to the adhesively secured to each other so as to define end closure(s) for the main box 78.

As noted above, to form the insert of the product package, the blank 60 further includes an insert portion 76, which in the illustrated embodiment is defined adjacent the third side panel 74. The insert portion 76 includes a front wall 96 and a side panel 98. In the illustrated embodiment, the insert side panel includes a first side wall portion 100 adapted to be oriented generally perpendicular to the front wall 96 of the insert portion 76 and a second portion 102 adapted to be generally parallel to the front wall 96.

The second portion 102 of the insert side panel 98 of the insert portion 76 has a glue or other adhesive material 104 applied thereto, on the unprinted side thereof in the illustrated embodiment, for purposes to be explained in greater detail below. A score line 106 is defined between the first and second portions 100, 102 of the side panel 98 to facilitate folding. In the illustrated embodiment, the score line 106 is a perforated line.

The insert portion of the blank also includes end closure structures 108, 118 for defining, with front wall 96, side wall portion 100 and back panel 62, the product-receiving compartment 130 of the package. In the presently proposed, preferred embodiment, one closure structure, closure end stop 108 extends laterally and includes at least two and preferably three segments 110, 114, 117 defined by perforated lines 112, 116. The purpose of end stop 108 is to define an end wall for the product-receiving compartment. Thus, front segment 110 of end stop 108 is contiguous with front wall 96, side segment 114 is adapted to be oriented generally perpendicular to the front segment 110, and back segment 117 is adapted to be generally parallel to front segment 110. As will be come apparent below, by orientation and attachment of segment 117 with adhesive 132 to the unprinted side of the front panel 66, on squaring, a vertical edge 120 is defined by segment 114, which provides an end stop for a product disposed in compartment 130.

As the product is preferably generally centered longitudinally of the main box 78, closure structure 118 is preferably provided at the opposite longitudinal end of the front wall 96 of the insert 76. In the illustrated embodiment, closure structure 118 is a closure tab that extends generally longitudinally of the insert blank 76, in a direction transverse to the longitudinal axis A of the blank 60. In accordance with a presently preferred embodiment of the invention, closure tab 118 includes a first portion 122 adapted to be oriented in a direction generally perpendicular to the front wall 96 when a product is disposed in the package, to define an end wall for compartment 130. In the illustrated embodiment, closure tab 118 also includes a second portion 126, with a score line 124 defined between portion 122 and 126. The second portion 126 is adapted to be oriented in parallel to the front wall 96. In the illustrated embodiment, closure panel 118 further includes a third portion or flap 128. Flap 128 facilitates opening the compartment 130 of the insert 76, to access the product. Also, when the corresponding end of the main box 78 is closed, tab 82 and closure panel 70 lock flap 128 generally in parallel to first portion 122, thus ensuring portion 122 will remain disposed generally perpendicular to front wall 96.

As an alternative to providing a transverse closure end stop 108, a longitudinal closure tab as described with reference to the closure tab 118 of the insert blank 76 could be provided at, e.g. the top end of the insert blank in lieu of end stop 108. Such a closure tab would define an end wall for an insert compartment but would not be an effectively permanent end wall, as is end stop 108 due to adhesive 132, so the product received in the compartment 130 could be accessed from each end of the product package.

Figure 4:
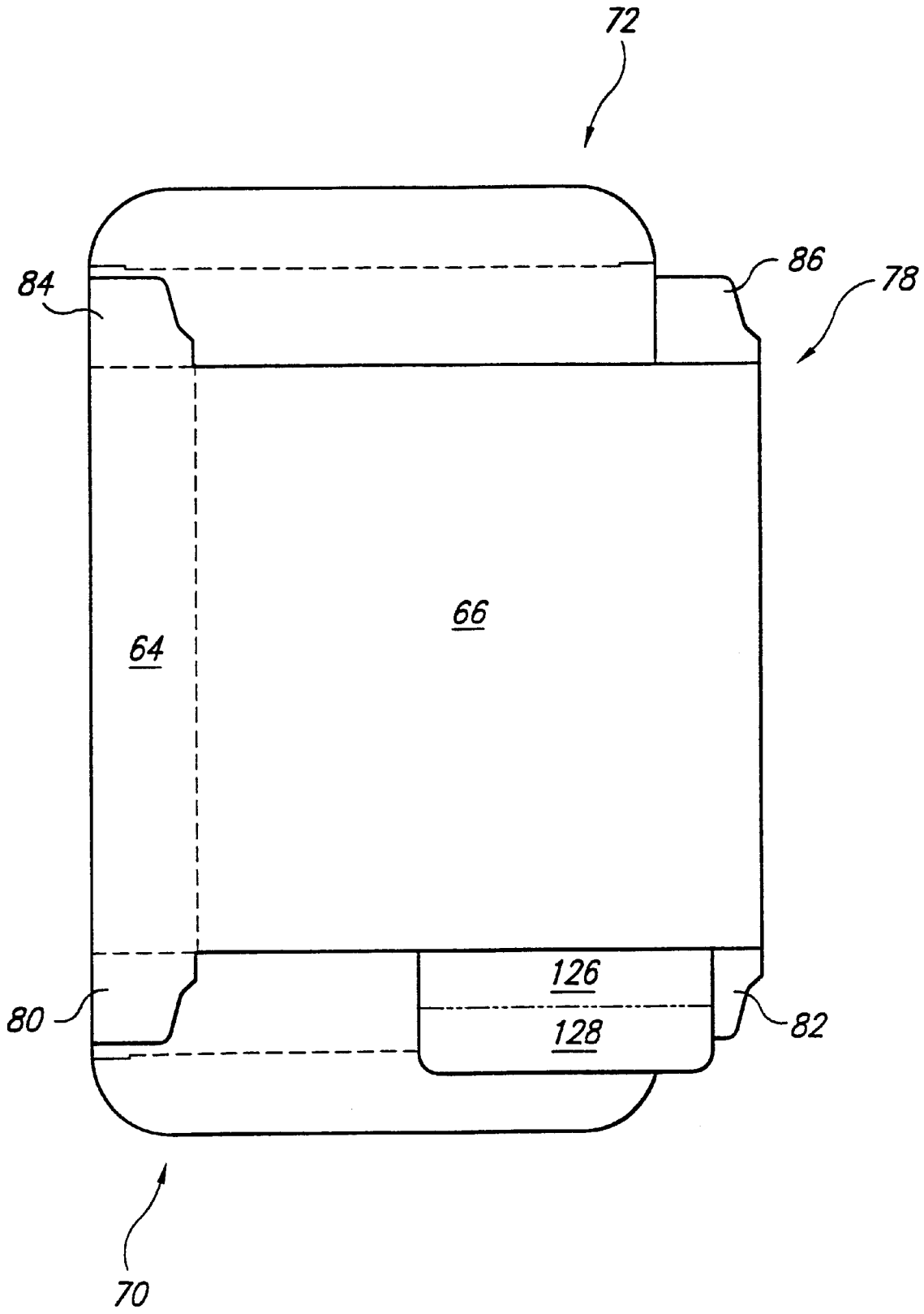
FIG. 4 is a plan view of a box formed from the blank of FIG. 3, before being squared to a three dimensional form.

With reference to FIG. 4, to form the box of the invention, the box blank is folded, for example, along score line 136. The adhesive 104 and adhesive 132 provided on the unprinted side of the insert portion 76 of the blank adheres to respective portions of the unprinted side of back panel 62 following this first folding operation. Then the blank 60 is folded along score line blank 138 so that the unprinted surface of front panel 66 generally overlies the unprinted surface of the back panel 62 and the printed surface of insert portion 76 disposed thereon. Finally, side panel 68 is folded along score line 140 so that the adhesive 142 provided on the printed side of the third side panel 74 adheres to the unprinted side of the second side panel 68.

Once the blank has been folded as aforesaid, with the blank configuration shown in FIG. 3, a folded box as shown in FIG. 4 will result. The box in this flattened configuration can be compactly stored and shipped until the product is to be inserted into the box, at which time the box is squared. On squaring, the box assumes the configuration shown, e.g., in FIGS. 5–7 for receiving the product (not shown) and any product literature (not shown).

Figure 7:
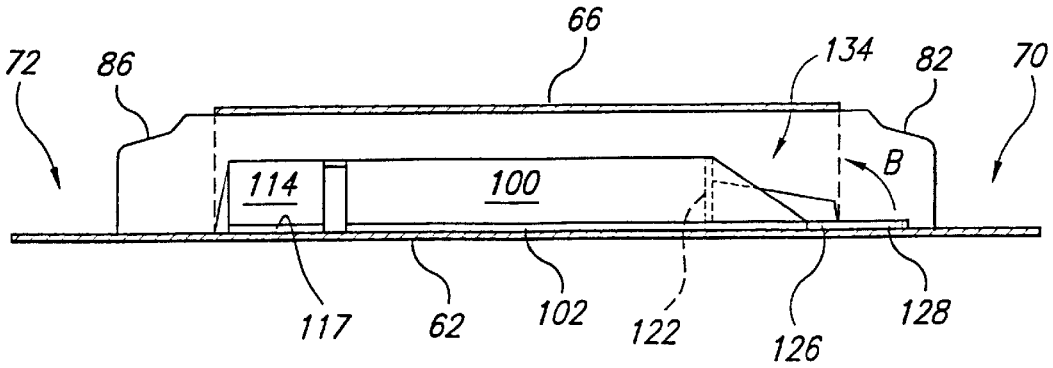
FIG. 7 is a side view taken along line 7—7 of FIG. 6.

In the illustrated embodiment, the side panel 98 of the insert 76 projects longitudinally beyond the front wall 96 as shown generally at 134 in FIGS. 3 and 7. The inclined upper surface of the projecting side panel guides product related literature into the slot defined above the product receiving insert structure 76. The projecting side panel also helps guide the product into compartment 130 without hindering the closing displacement of tab 118. Further, the extending portion guides the tab 118 to its proper compartment 130 closing disposition and, once panel 122 of closure tab 118 has been displaced to define the compartment end wall, the respective panels advantageously help maintain the box square. This increases the strength of the insert compartment 130, thereby shielding the product from modest crushing forces, which might otherwise tend to collapse the box blank to its flattened form (FIG. 4). In the event a longitudinal closure tab is provided at the opposite end of the front wall, then the side panel 100 preferably projects at that end as well.

Figure 5:
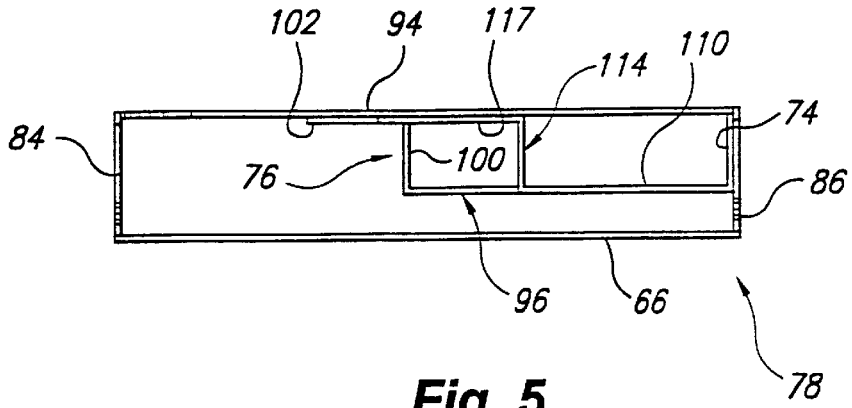
FIG. 5 is a top end view of the box shown in FIG. 4, after it has been squared for receiving a product.
Figure 6:
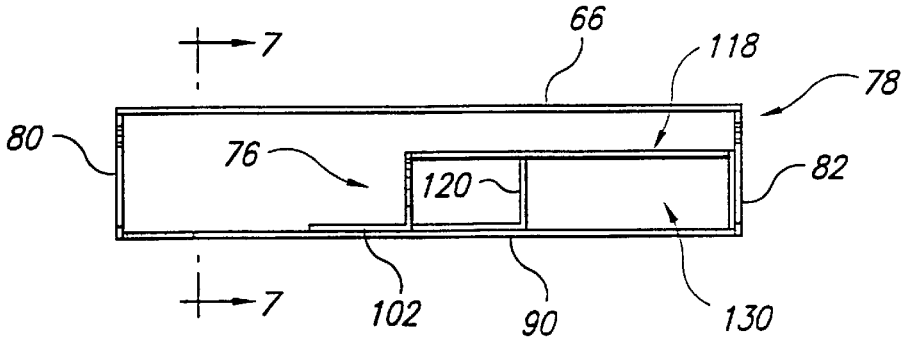
FIG. 6 is a bottom end view of the box of FIG. 4, after it has been squared for receiving a product.

With reference to FIG. 5, in the illustrated embodiment, one end of the product-receiving compartment is automatically defined on squaring by side edge 120 of the transverse end stop 108. On squaring, however, closure tab 118 remains in a plane or orientation extending generally continuously from the front wall 96. Thus, the package is configured for receiving the product into the product compartment 130 defined by the package insert 76. Once the product has been inserted, the closure tab 118 is folded along the score lines thereof, such as perforation line 124, to define the other end wall 122 of the product compartment. To maintain that end wall 122 in position, in the illustrated embodiment, the end tab includes portion 126 for being disposed parallel to the bottom panel 62 of the main box 78 and also end portion 128 for being disposed in parallel to the end panel 88 of the main box 78, as shown by arrow B. The end portion 128 facilitates grasping the closure tab 118 to open compartment 130 for accessing the product disposed therewithin and, as noted above, also encourages the closure tab 118 and in particular panel 122 to remain in position following product insertion and box end closure.

Figure 8:
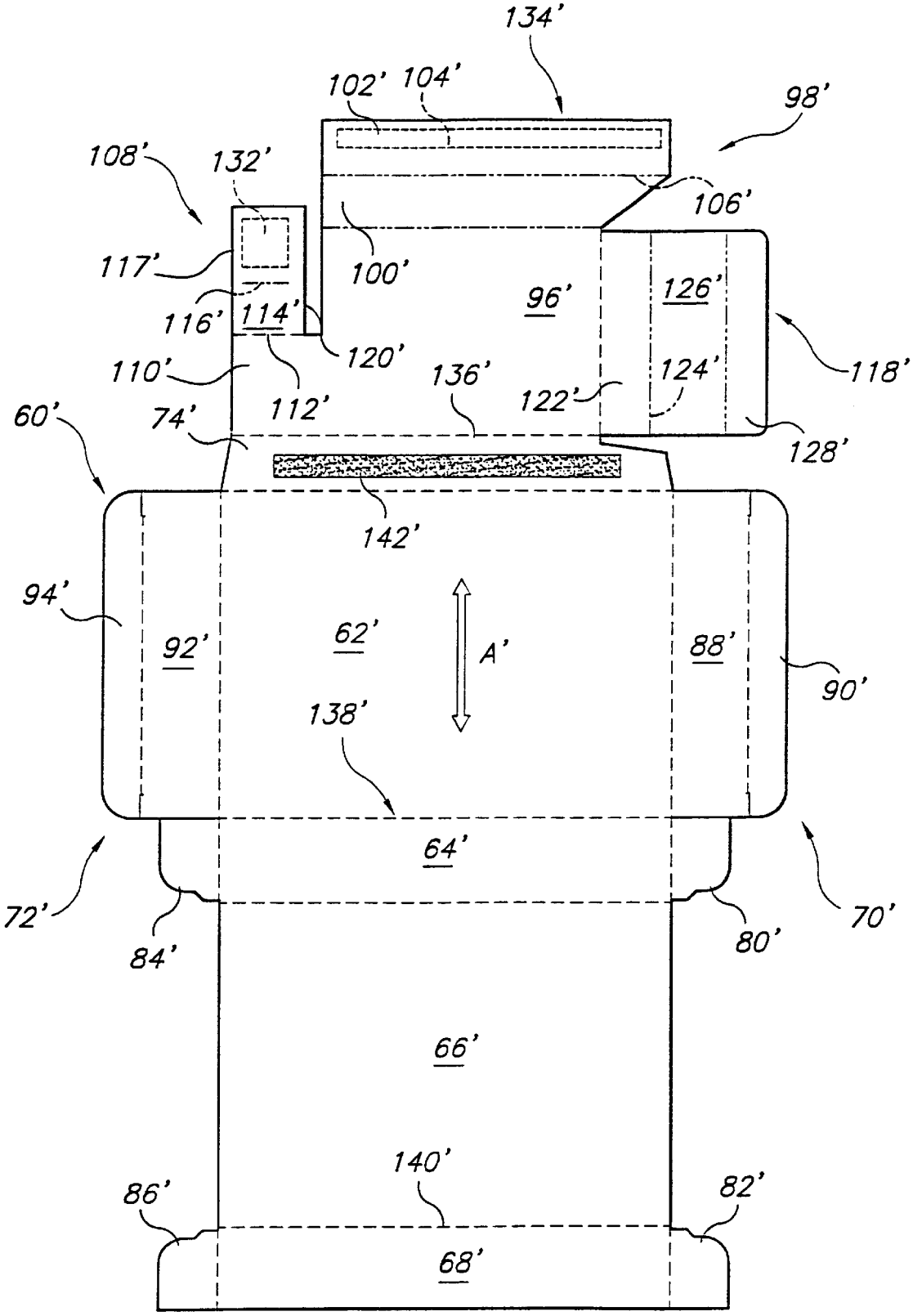
FIG. 8 is a plan view of a box blank formed in accordance with another embodiment of the present invention.

FIG. 8 illustrates an alternative embodiment of the invention adapted to form a box that is dimensionally different from the box formed from the blank of FIG. 3, e.g., rectangular, not square, and deeper. The blank 60' of FIG. 8 has panels, tabs, score lines and the like which generally correspond to the panels, tabs, score lines and the like of the blank 60 of FIG. 3. Thus, even though, for example, the front and back panels 66', 62' are longer to define a rectangular box and the side panels 64', 68' are wider to define a deeper box, reference numerals corresponding to those used in FIG. 3, but designated with a prime (′), have been used throughout FIG. 8. Moreover, as the disclosure with respect to FIG. 3 is generally applicable to the blank 60' of FIG. 8, it is not repeated here. As can be seen, in the embodiment of FIG. 8, the insert portion 76' is shown disposed as the longitudinal mirror image of the insert portion 76 of the FIG. 3 embodiment. It is to be understood that the insert portion may be oriented as shown in FIG. 3 or FIG. 8, irrespective of particulars of the shape and dimensions of the box to be formed. Moreover, it is to be understood that the insert portion 76, 76' may be provided adjacent the "back" or the "front" of the box without departing from the invention.

It will be realized that the foregoing preferred specific embodiments of the present invention have been shown and described for purposes of illustrating the functional and structural principles of this invention and are subject to change without departure from such principles. Therefore this invention includes all modifications encompassed within the spirit and scope of the following claims.

What is claimed is:

1. A box having an integral compartment defining insert, comprising:

a one piece blank prescored to define:

a back panel, said back panel having a first side edge, a second side edge, a first end edge and a second end edge;

a first side panel hingedly coupled along one longitudinal side thereof to said first side edge of said back panel;

a front panel, said front panel having first and second side edges and first and second end edges, said front panel being hingedly coupled along said first side edge thereof to the other longitudinal side edge of said first side panel;

a first end panel hingedly coupled along one longitudinal side thereof to the first end edge of one of said back panel and said front panel;

a second end panel hingedly coupled along one longitudinal side thereof to the second end edge of one of said back panel and said front panel;

a second side panel hingedly coupled along one longitudinal side thereof to said second side edge of said front panel;

a third side panel hingedly coupled along one longitudinal side edge thereof to said second side edge of said back panel, and an insert portion hingedly coupled to the other longitudinal side edge of said third side panel, said insert portion being pre-scored to define:

a front wall panel and a first side wall portion for defining an insert compartment with a portion of said back panel, and first and second closure structures for defining a longitudinal end wall at each longitudinal end of the insert compartment.

2. A box as in claim 1, wherein said front wall panel is hingedly coupled along a first longitudinal side edge thereof to said other longitudinal side edge of said third side panel and first side wall portion is hingedly coupled to a second longitudinal side edge of said front wall panel.

3. A box as in claim 2, wherein said insert portion further comprises a second side wall portion hingedly coupled to a second longitudinal side edge of said first side wall portion.

4. A box as in claim 1, wherein said first closure structure comprises a closure tab including a first end wall portion hingedly coupled along one longitudinal side thereof to a first end edge of said front wall panel.

5. A box as in claim 4, wherein said closure tab further comprises a second end wall portion hingedly coupled along one longitudinal side edge thereof to the other longitudinal side edge of said first end wall portion.

6. A box as in claim 5, further comprising a third end wall portion hingedly coupled along one longitudinal side edge thereof to the other longitudinal side edge of said second end wall portion.

7. A box as in claim 1, wherein said front wall panel has first and second longitudinal ends, said second closure structure comprises a closure end stop defined at said second longitudinal end of said front wall panel and wherein said closure end stop comprises:

a front segment extending from and substantially contiguous with said front wall panel, said front segment having a width less than a width of said front wall panel, and a side segment hingedly coupled along one side edge thereof to a side edge of said front segment for being selectively pivoted about an axis defined by the hinged coupling, said axis extending longitudinally of said front wall panel.

8. A box as in claim 7, further comprising a back segment hingedly coupled along a side edge thereof to said side segment.

9. A box as in claim 8, wherein said first closure structure comprises a closure tab defined at the first longitudinal end of said front wall panel, said closure tab including a first end wall portion hingedly coupled along one longitudinal side thereof to said other longitudinal end of said front wall panel.

10. A box as in claim 9, wherein said closure tab further comprises a second end wall portion hingedly coupled along one longitudinal side edge thereof to the other longitudinal side edge of said first end wall portion.

11. A box as in claim 10, further comprising a third end wall portion hingedly coupled along one longitudinal side edge thereof to the other longitudinal side edge of said second end wall portion.

12. A box as in claim 2, wherein said third side panel has a width less than a width of said second side panel.

13. A box as in claim 2, wherein a width of said first end wall portion substantially corresponds to a width of said first side wall portion.

14. A box as in claim 7, wherein a width of said side segment substantially corresponds to a width of said first side wall portion.

15. A box as in claim 1, wherein said first end panel comprises first and second end panel portions, a width of said first end panel portion substantially corresponding to a width of said first side panel.

16. A method forming a box from a one piece box blank comprising:

(a) providing a one piece blank having first and second surfaces and pre-scored to define:

a back panel, said back panel having a first side edge, a second side edge, a first end edge and a second end edge;

a first side panel hingedly coupled along one longitudinal side thereof to said first side edge of said back panel;

a front panel, said front panel having first and second side edges and first and second end edges, said front panel being hingedly coupled along said first side edge thereof to the other longitudinal side edge of said first side panel;

a first end panel hingedly coupled along one longitudinal side thereof to the first end edge of one of said back panel and said front panel;

a second end panel hingedly coupled along one longitudinal side thereof to the second end edge of one of said back panel and said front panel;

a second side panel hingedly coupled along one longitudinal side thereof to said second side edge of said front panel;

a third side panel hingedly coupled along one longitudinal side edge thereof to said second side edge of said back panel, and an insert portion hingedly coupled to the other longitudinal side edge of said third side panel, said insert portion being pre-scored to define:

a front wall panel hingedly coupled along a first longitudinal side edge thereof to said other longitudinal side edge of said third side panel, a first side wall portion hingedly coupled to a second longitudinal side edge of said front wall panel, said front wall panel and said first side wall portion being adapted to define an insert compartment with a portion of said back panel, a second side wall portion hingedly coupled to a second longitudinal side edge of said first side wall portion, a first closure structure for defining a longitudinal end wall of the insert compartment; and a second closure structure for defining a second longitudinal end wall of the insert compartment;

(b) providing an adhesive on first surface of said second side wall portion and on one of (1) said second side of said third side panel and (2) said first side of said second side panel;

(c) folding the one piece blank along a scoreline defined at the juncture of the insert portion and third side panel so that said adhesive on said second side wall portion adheres to said first side of said back panel;

(d) folding the blank along a scoreline defined at the juncture of said back portion and said first side panel so that said first surface of said front panel overlies the first surface of said back panel and the second surface of the insert portion, and, then, (e) folding said second side panel along a scoreline defined at its juncture with said front panel so as to adhere the first side of the second side panel to the second side of the third side panel.

17. A method as in claim 16, further comprising squaring the box formed by steps (a)–(e), into a three dimensional box by shifting said back and/or front panels so as to be spaced apart by a distance corresponding to a width of said first side panel.

18. A method as in claim 16, wherein said providing step further comprises providing a blank pre-scored to define a closure structure comprising a closure end stop defined at one longitudinal end of said front wall panel and wherein said closure end stop comprises:

a front segment extending from and substantially contiguous with said front wall panel, said front segment having a width less than a width of said front wall panel, a side segment hingedly coupled along one side edge thereof to a side edge of said front segment for being selectively pivoted about an axis defined by the hinged coupling, said axis extending longitudinally of said front wall panel, and a back segment hingedly coupled along a side edge thereof to said side segment, and wherein said step of providing an adhesive further comprises providing an adhesive on the first surface of said back segment.

19. A box as in claim 17, wherein said providing step further comprises providing a blank pre-scored to define a closure structure comprising a closure tab including a first end wall portion hingedly coupled along one longitudinal side thereof to a first end edge of said front wall panel, and further comprising, after said squaring step, folding said first end wall portion along a scoreline defined at the juncture thereof with said front wall panel so that said first end wall portion is disposed substantially perpendicular to said front wall panel.

20. A method forming a box from a one piece box blank comprising:

(a) providing a one piece blank having first and second surfaces and pre-scored to define:

a back panel, said back panel having a first side edge, a second side edge, a first end edge and a second end edge;

a first side panel hingedly coupled along one longitudinal side thereof to said first side edge of said back panel;

a front panel, said front panel having first and second side edges and first and second end edges, said front panel being hingedly coupled along said first side edge thereof to the other longitudinal side edge of said first side panel;

a first end panel hingedly coupled along one longitudinal side thereof to the first end edge of one of said back panel and said front panel;

a second end panel hingedly coupled along one longitudinal side thereof to the second end edge of one of said back panel and said front panel;

a second side panel hingedly coupled along one longitudinal side thereof to said second side edge of said front panel;

a third side panel hingedly coupled along one longitudinal side edge thereof to said second side edge of said back panel, and an insert portion hingedly coupled to the other longitudinal side edge of said third side panel, said insert portion being pre-scored to define:

a front wall panel hingedly coupled along a first longitudinal side edge thereof to said other longitudinal side edge of said third side panel, a first side wall portion hingedly coupled to a second longitudinal side edge of said front wall panel, said front wall panel and said first side wall portion being adapted to define an insert compartment with a portion of said back panel, a second side wall portion hingedly coupled to a second longitudinal side edge of said first side wall portion, and a closure structure for defining a longitudinal end wall of the insert compartment;

(b) providing an adhesive on first surface of said second side wall portion and on one of (1) said second side of said third side panel and (2) said first side of said second side panel;

(c) folding the one piece blank along a scoreline defined at the juncture of the insert portion and third side panel so that said adhesive on said second side wall portion adheres to said first side of said back panel;

(d) folding the blank along a scoreline defined at the juncture of said back portion and said first side panel so that said first surface of said front panel overlies the first surface of said back panel and the second surface of the insert portion, and, then, (e) folding said second side panel along a scoreline defined at its juncture with said front panel so as to adhere the first side of the second side panel to the second side of the third side panel, wherein said step of providing a blank further comprises providing a blank pre-scored to define a closure structure comprising a closure end stop defined at one longitudinal end of said front wall panel and wherein said closure end stop comprises:

a front segment extending from and substantially contiguous with said front wall panel, said front segment having a width less than a width of said front wall panel, a side segment hingedly coupled along one side edge thereof to a side edge of said front segment for being selectively pivoted about an axis defined by the hinged coupling, said axis extending longitudinally of said front wall panel.

21. A box having an integral compartment defining insert, comprising:

a one piece blank prescored to define:

a back panel, said back panel having a first side edge, a second side edge, a first end edge and a second end edge;

a first side panel hingedly coupled along one longitudinal side thereof to said first side edge of said back panel;

a front panel, said front panel having first and second side edges and first and second end edges, said front panel being hingedly coupled along said first side edge thereof to the other longitudinal side edge of said first side panel;

a first end panel hingedly coupled along one longitudinal side thereof to the first end edge of one of said back panel and said front panel;

a second end panel hingedly coupled along one longitudinal side thereof to the second end edge of one of said back panel and said front panel;

a second side panel hingedly coupled along one longitudinal side thereof to said second side edge of said front panel;

a third side panel hingedly coupled along one longitudinal side edge thereof to said second side edge of said back panel, and an insert portion hingedly coupled to the other longitudinal side edge of said third side panel, said insert portion being pre-scored to define:

a front wall panel and a first side wall portion for defining an insert compartment with a portion of said back panel, and a closure structure for defining a longitudinal end wall of the insert compartment, wherein said front wall panel has first and second longitudinal ends, and said closure structure includes a closure end stop defined at one longitudinal end of said front wall panel, said closure end stop comprising:

a front segment extending from and substantially contiguous with said front wall panel, a side segment hingedly coupled along one side edge thereof to a side edge of said front segment for being selectively pivoted about an axis defined by the hinged coupling, said axis extending longitudinally of said front wall panel, and a back segment hingedly coupled along a side edge thereof to said side segment, and further comprising an adhesive disposed on a surface of said back segment.

* * * * *